United States Patent [19]

Minks

[11] Patent Number: 4,484,168

[45] Date of Patent: Nov. 20, 1984

[54] ELECTROMAGNETIC RELAY

[75] Inventor: Werner Minks, Heroldsberg, Fed. Rep. of Germany

[73] Assignee: International Standard Electric Corporation, New York, N.Y.

[21] Appl. No.: 562,260

[22] Filed: Dec. 16, 1983

[30] Foreign Application Priority Data

Mar. 5, 1983 [DE] Fed. Rep. of Germany ..... 3307921

[51] Int. Cl.[3] ..... H01F 7/13

[52] U.S. Cl. ..... 335/274; 335/276

[58] Field of Search ..... 335/270, 271, 274, 275, 335/276, 279

[56] References Cited

U.S. PATENT DOCUMENTS 3,161,806 12/1964 Gordon ..... 335/274 X 3,474,367 10/1969 Zupa ..... 335/274

FOREIGN PATENT DOCUMENTS 126076 12/1931 Austria ..... 335/274

*Primary Examiner*—George Harris

*Attorney, Agent, or Firm*—T. E. Kristofferson; T. L. Peterson

[57] ABSTRACT

An electromagnetic relay with an angular armature and a U-shaped yoke disposed on the coil form flange. The yoke comprises two legs extending in the direction of the coil axis, and a crosspiece having a foil-spring portion which rests on the angular edge of the tilting armature. The crosspiece carrying the foil-spring portion is clamped into position between the two legs. The crosspiece is made from a resilient material and is provided at its ends with flap members which engage into corresponding slots formed at the ends of the legs.

3 Claims, 2 Drawing Figures

ELECTROMAGNETIC RELAY

BACKGROUND OF THE INVENTION

The present invention relates to an electromagnetic relay.

Published German patent application DE-OS No. 30 08783 discloses a relay in which the coil form together with the U-yoke carrying the foil-spring portion consists of one single molded plastic part. This type of relay has proved well suitable in practice. However, to obtain high accuracies during manufacture of the relay, it is necessary to adhere exactly to the molding conditions of the coilform, especially to the temperature, and the mixing ratios in the case of plastic materials mixed with reinforcing fiber materials.

It is the object of the present invention to permit an economical and qualitatively high-grade manufacture of the foil-spring portion while maintaining the same good or even better functioning thereof, in spite of low precision requirements in manufacturing the coilform.

SUMMARY OF THE INVENTION

According to the principal aspect of the invention, in a relay of the type described above the crosspiece with the foil-spring portion is an inexpensive punched part made of a suitable resilient material, such as spring bronze. By elastically deflecting the legs of the U-yoke of the relay and/or the crosspiece, the crosspiece can easily be engaged into slots formed in the legs. In this way, it is possible to replace the cross-piece with the foil-spring portion by a different one whose spring action acts in a different intensity and/or in a different angle upon the tilting armature of the relay. Thus, the coilform can also be used with differently designed tilting armatures, hence e.g., for different types of relays.

DESCRIPTION OF THE PREFERRED EMBODIMENT

Figure 1:
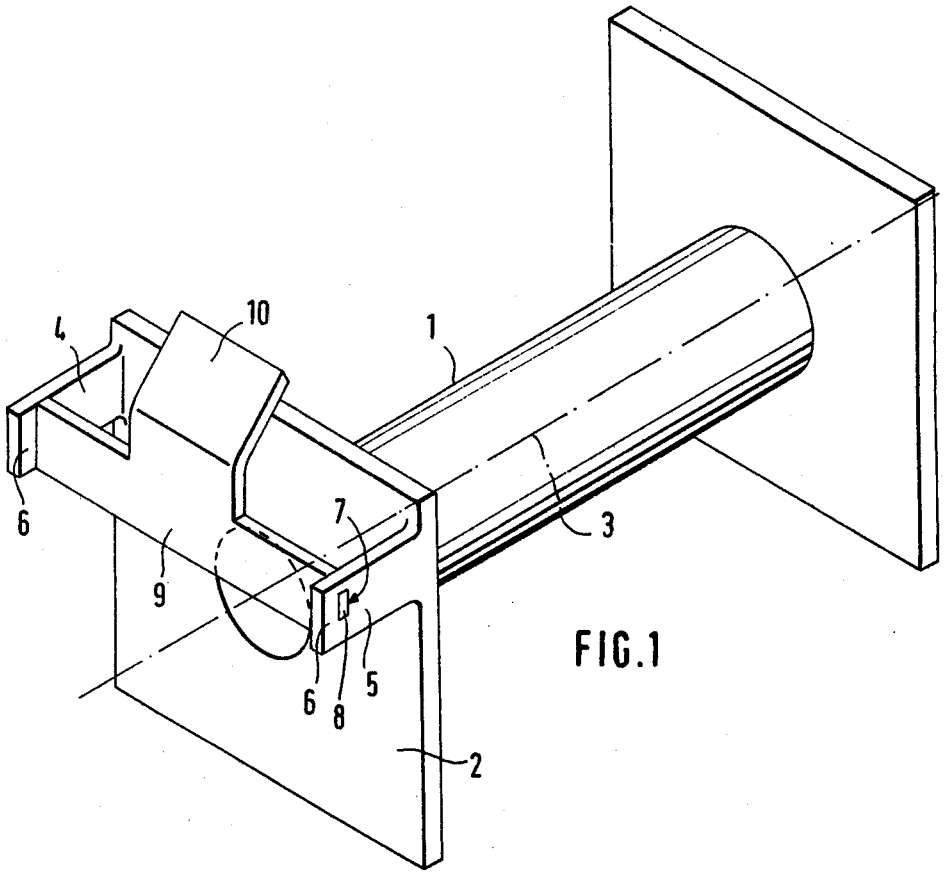
FIG. 1 is a perspective view of a coilform incorporating the crosspiece of the invention.
Figure 2:
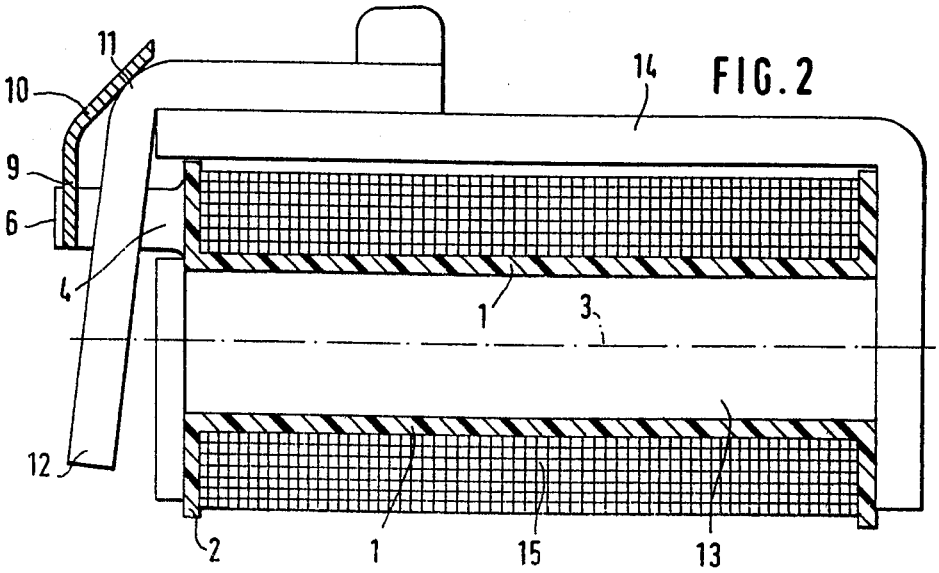
FIG. 2 is a longitudinal sectional view of the same coilform wound and provided with a magnet system.

FIG. 1 shows a relay coilform 1 injection-molded from an elastic plastic material. Molded to one flange 2 of the coilform are two legs 4, 5 extending in the direction of the coil axis 3. Each leg 4 and 5 is provided at its end 6 with at least one slot 7. The slots are engaged by flap members 8 formed on the ends of a crosspiece 9 of an elastic resilient material. The engagement is effected by elastically deflecting the legs 4, 5 and/or the crosspiece 9. Both the slots 7 and the flap members 8 are so designed that there is obtained a fixing of the crosspiece 9 without any backlash. In this way, the legs 4, 5 together with the crosspiece 9 form a U-shaped yoke.

The crosspiece 9 has an integral foil-spring portion 10 which resiliently presses against the angular edge of an angular tilting armature 12 of the magnetic circuit consisting of the core 13 and the magnetic yoke 14. A magnetic coil 15 is wound around the core of the coilform. The crosspiece 9 with the integral foil-spring portion 10 may be formed of a resilient metal, such as spring bronze, by a stamping operation or the like.

For increasing the strength of the coilform 1, especially when subjected to higher temperatures, the plastic material may be reinforced with fiber, such as glass fibers.

What is claimed is:

1. In an electromagnetic relay having an angular armature and a U-shaped yoke on the flange of the coilform, said yoke comprising legs extending in the direction of the coil axis and a crosspiece, a foil-spring portion on said crosspiece resting on the angular edge of the angular armature, the improvement comprising:

both said coilform and said legs comprising one single molded plastic part;

said crosspiece and said foil-spring portion being formed of a resilient metal; and the ends of said crosspiece embodying flap members engaged within corresponding slots formed in said legs for fixing said crosspiece in position.

2. A relay as set forth in claim 1 wherein:

said coilform is formed of a fiber-reinforced plastic material.

3. A relay as set forth in claim 1 wherein:

said crosspiece together with said foil-spring portion are made of spring bronze.

* * * * *